US007594799B2

(12) United States Patent
Miller et al.

(10) Patent No.: US 7,594,799 B2
(45) Date of Patent: Sep. 29, 2009

(54) UNDERCUT FILLET RADIUS FOR BLADE DOVETAILS

(75) Inventors: William John Miller, Simpsonville, SC (US); Bruce C. Busbey, Greer, SC (US); William E. Dixon, Greer, SC (US); Lynn M. Naparty, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 330 days.

(21) Appl. No.: 11/519,802

(22) Filed: Sep. 13, 2006

(65) Prior Publication Data

US 2008/0063529 A1 Mar. 13, 2008

(51) Int. Cl.
*F01D 5/30* (2006.01)

(52) U.S. Cl. ..... 416/219 R; 416/248

(58) Field of Classification Search ..... 416/219 R, 416/219 A, 248

See application file for complete search history.

(56) References Cited

U.S. PATENT DOCUMENTS 4,692,976 A * 9/1987 Andrews ..... 416/219 R
5,152,669 A * 10/1992 Heinig et al. ..... 416/219 R
5,435,694 A * 7/1995 Kray et al. ..... 416/219 R
5,988,980 A 11/1999 Busbey et al.
6,033,185 A * 3/2000 Lammas et al. ..... 416/219 R
6,106,188 A * 8/2000 Krautzig et al. ..... 416/220 R
6,183,202 B1 * 2/2001 Ganshaw ..... 416/219 R
6,769,877 B2 8/2004 Martin et al.
6,860,721 B2 * 3/2005 Knott et al. ..... 416/219 R
6,902,376 B2 * 6/2005 Gautreau et al. ..... 416/219 R
7,121,803 B2 10/2006 Gautreau et al.

FOREIGN PATENT DOCUMENTS

JP 59113206 A * 6/1984

OTHER PUBLICATIONS

FLS, Inc., Blade Attaching Structure For Turbomachine (JP 59-113206 A, Hatsutori et al. Translation), Jan. 2009, pp. 1-9.*
Merriam-Webster's Online Dictionary, "either", accessed Mar. 23, 2009, http://www.merriam-webster.com/dictionary/either[1].*

* cited by examiner

*Primary Examiner*—Richard Edgar
(74) *Attorney, Agent, or Firm*—Nixon & Vanderhye P.C.

(57) ABSTRACT

A turbine or compressor blade assembly includes a blade fixed to a dovetail section attachable to a wheel. The dovetail section has a dovetail shaped to fit in a correspondingly shaped slot in the wheel. A dovetail platform serves as an interface between the blade and the dovetail. An undercut fillet radius is formed at an intersection of the dovetail platform and a dovetail pressure surface, where the undercut radius has a multi-part profile shape configured to attenuate edge of contact stresses. An additional feature is the area where the undercut radius transitions into the P-cut area at the forward end (leading edge) of the dovetail.

13 Claims, 3 Drawing Sheets

UNDERCUT FILLET RADIUS FOR BLADE DOVETAILS

BACKGROUND OF THE INVENTION

The invention relates to stress reduction in the interface between a blade dovetail and a wheel slot and, more particularly, to a dovetail section including an undercut fillet radius having a multi-part profile shape formed at an intersection of the dovetail platform and a dovetail pressure surface.

FIGS. 1 and 2 show a conventional compressor blade assembly including a blade 12 fixed to a dovetail section 14, which is attachable to a compressor wheel (not shown). An analysis of a failed blade shows that the failure resulted from fretting on the dovetail pressure surfaces 16 near the small fillet radius 18 that transitions from the blade neck 20 to the dovetail platform 22. The analysis showed the stress in the small 0.022 fillet radius 18 was substantial enough to grow micro-cracks in the fretted area eventually causing ultimate failure (blade liberation). A subsequent review of several hundred parts showed fretting was prevalent in these areas in nearly all parts observed.

An undercut radius concept on compressor blade dovetails has been previously proposed. See, for example, U.S. Pat. No. 6,769,877. A subsequent dovetail section design incorporated a "P-cut" feature 24 as shown in FIG. 2. The P-cut feature 24 in the dovetail 14 creates a change in the stress profile unlike that seen on a typical compressor blade dovetail. The prior undercut radius concept did not accommodate this unique stress profile and had a negative affect on the design stress parameters of the P-cut section 24.

BRIEF DESCRIPTION OF THE INVENTION

In an exemplary embodiment of the invention, in a turbine or compressor blade assembly including a blade fixed to a dovetail section attachable to a wheel, the dovetail section includes a dovetail shaped to fit in a correspondingly shaped slot in the wheel, a dovetail platform serving as an interface between the blade and the dovetail, and an undercut fillet radius formed at an intersection of the dovetail platform and a dovetail pressure surface. The undercut radius has a multi-part profile shape configured to attenuate edge of contact stresses.

In another exemplary embodiment of the invention, a rotor assembly includes a rotor wheel including a plurality of slots, and a plurality of blade assemblies each including a blade and a dovetail section engageable in a respective one of the rotor wheel slots. The dovetail section of each of the blade assemblies includes a dovetail shaped to fit in a correspondingly shaped slot in the wheel, a dovetail platform serving as an interface between the blade and the dovetail, and an undercut fillet radius formed at an intersection of the dovetail platform and a dovetail pressure surface. The undercut radius has a multi-part profile shape configured to attenuate edge of contact stresses.

In still another exemplary embodiment of the invention, a method of manufacturing a dovetail section for a compressor or turbine blade assembly engageable with a wheel slot in a rotor wheel includes the steps of providing a dovetail shaped to fit in the wheel slot, and forming an undercut fillet radius at an intersection of dovetail platform and a dovetail pressure surface. The undercut radius is formed with a multi-part profile shape configured to attenuate edge of contact stresses, the multi-part profile shape including at least a large radius part, a small radius part, and a flat part.

DETAILED DESCRIPTION OF THE INVENTION

Figure 1:
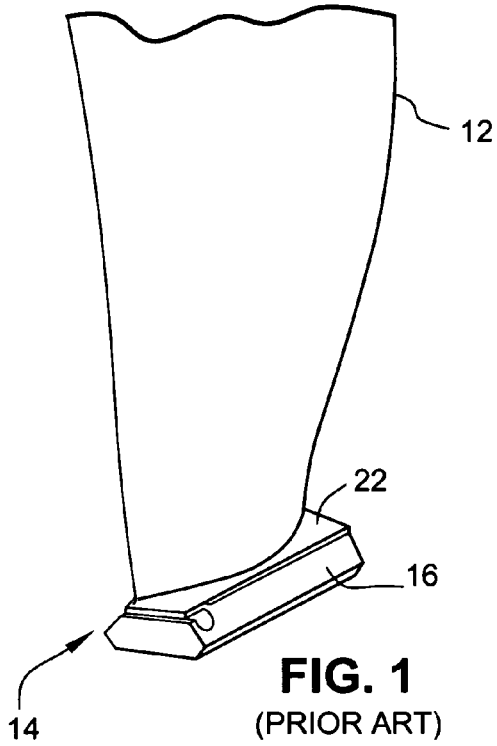
FIG. 1 (PRIOR ART)
FIG. 1 is a perspective view of a conventional compressor blade assembly.
Figure 2:
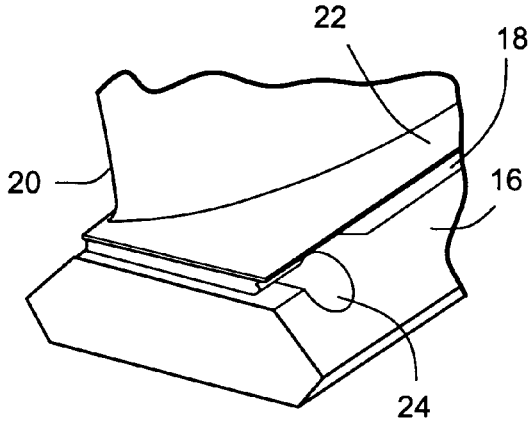
FIG. 2 (PRIOR ART)
FIG. 2 is a close-up view of the conventional compressor blade assembly dovetail section.
Figure 3:
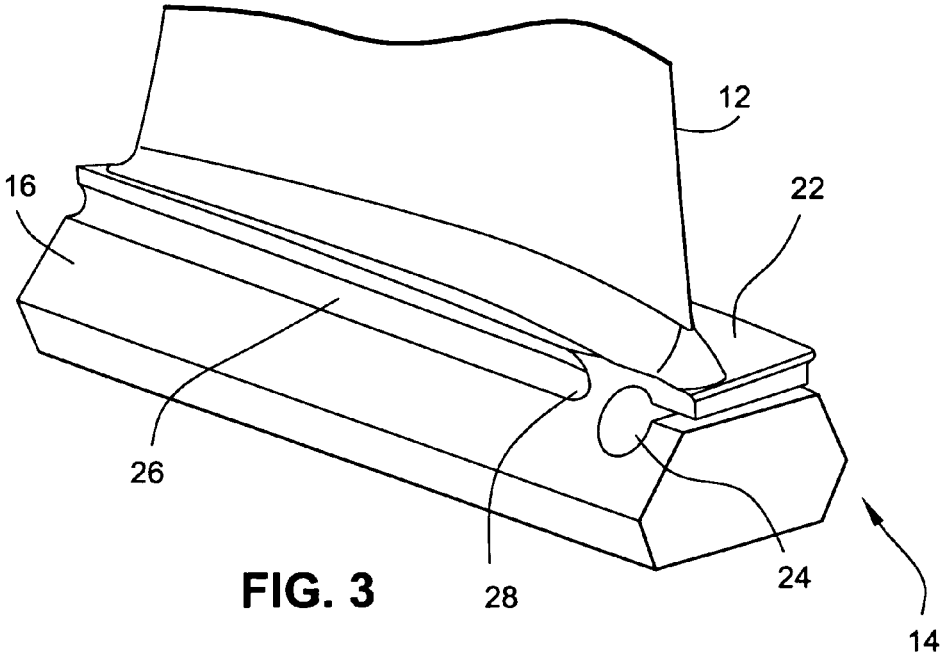
FIG. 3 is a perspective view of a dovetail section incorporating features of the invention described herein.

FIG. 3 is a perspective view of a turbine or compressor blade assembly including a modified dovetail section. The blade assembly includes a blade 12 (airfoil portion), a dovetail platform 22, and an attachment or root portion (dovetail section) 14 that typically is formed with a dovetail configuration, which enables the blade assembly to be loaded onto a compressor wheel or rotor 30 (see FIGS. 4-6).

A P-cut 24 relief slot is formed at the forward end of the dovetail section 14. This feature reduces the airfoil leading edge stresses making the blade less susceptible to damage on the leading edge.

Material is removed from and along the front face of the dovetail pressure surface 16 to form an undercut fillet radius 26 at an intersection of the dovetail platform 22 and the dovetail pressure surface 16. The undercut radius 26 extends toward a forward end of the dovetail 14, wherein an axial location of the undercut fillet radius termination is defined a predetermined distance 28 from the P-cut.

Figure 4:
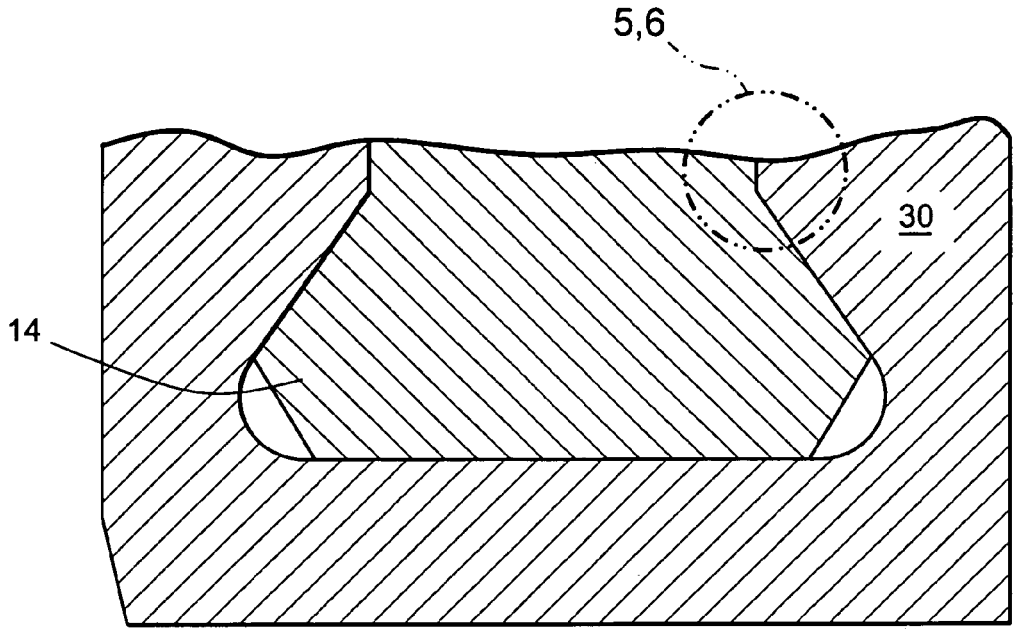
FIG. 4 illustrates the interface section of interest between the blade dovetail and a compressor wheel.
Figure 5:
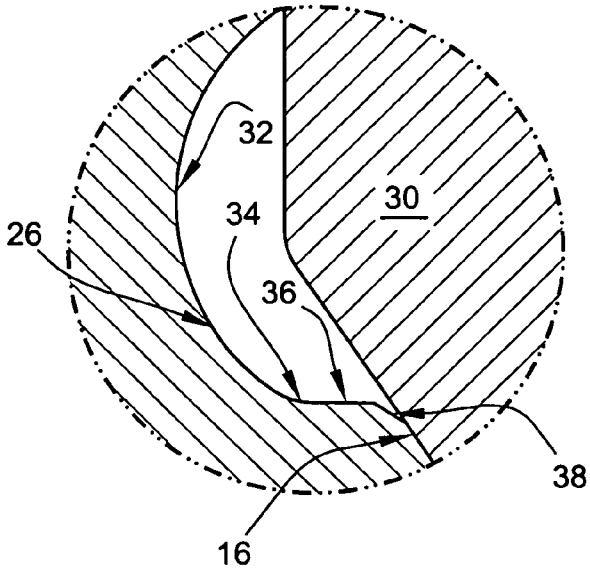
FIG. 5 is a close-up view of the dovetail/wheel interface incorporating features of the invention described herein.
Figure 6:
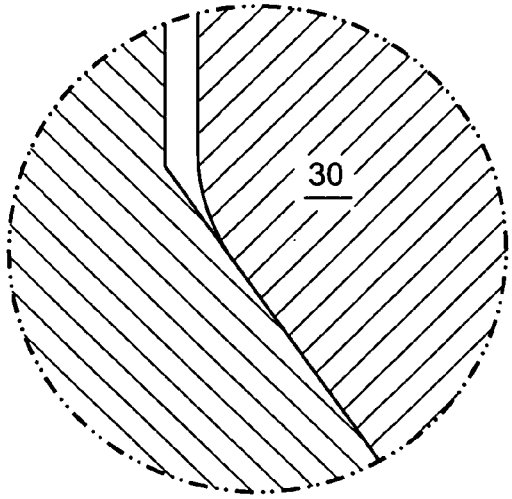
FIG. 6 (PRIOR ART)
FIG. 6 is a close-up view of a conventional dovetail/wheel interface.

With reference to FIGS. 4-6, FIG. 4 illustrates the interface surface of interest between the dovetail section 14 and the compressor wheel 30. FIG. 6 is a close-up view of a prior art design 0.022 fillet radius. As noted, it has been discovered that fretting on the dovetail pressure surfaces near the small fillet radii that transitions from the neck to the dovetail platform has caused compressor blade failures. FIG. 5 illustrates a preferred resolution of the problem including a larger fillet radius at the pressure surface 16 to platform 22 intersection including a multi-part profile shape configured to attenuate edge of contact stresses.

A preferred multi-part profile includes at least a three-part profile shape including a large radius part 32, a small radius part 34, and a flat part 36. This three-part design provides an improved stress state in the undercut 26 compared to a single radius design (e.g., FIG. 6). Finite element analyses were performed on both the prior art and the undercut concept (FIG. 6 and FIG. 5, respectively). The prior art FIG. 6 results were calibrated to engine-measured stresses thus validating the analysis technique. The undercut concept FIG. 5 results demonstrated a stress reduction at operating conditions of approximately 40% steady stress and approximately 50% vibratory stress.

Figure 7:
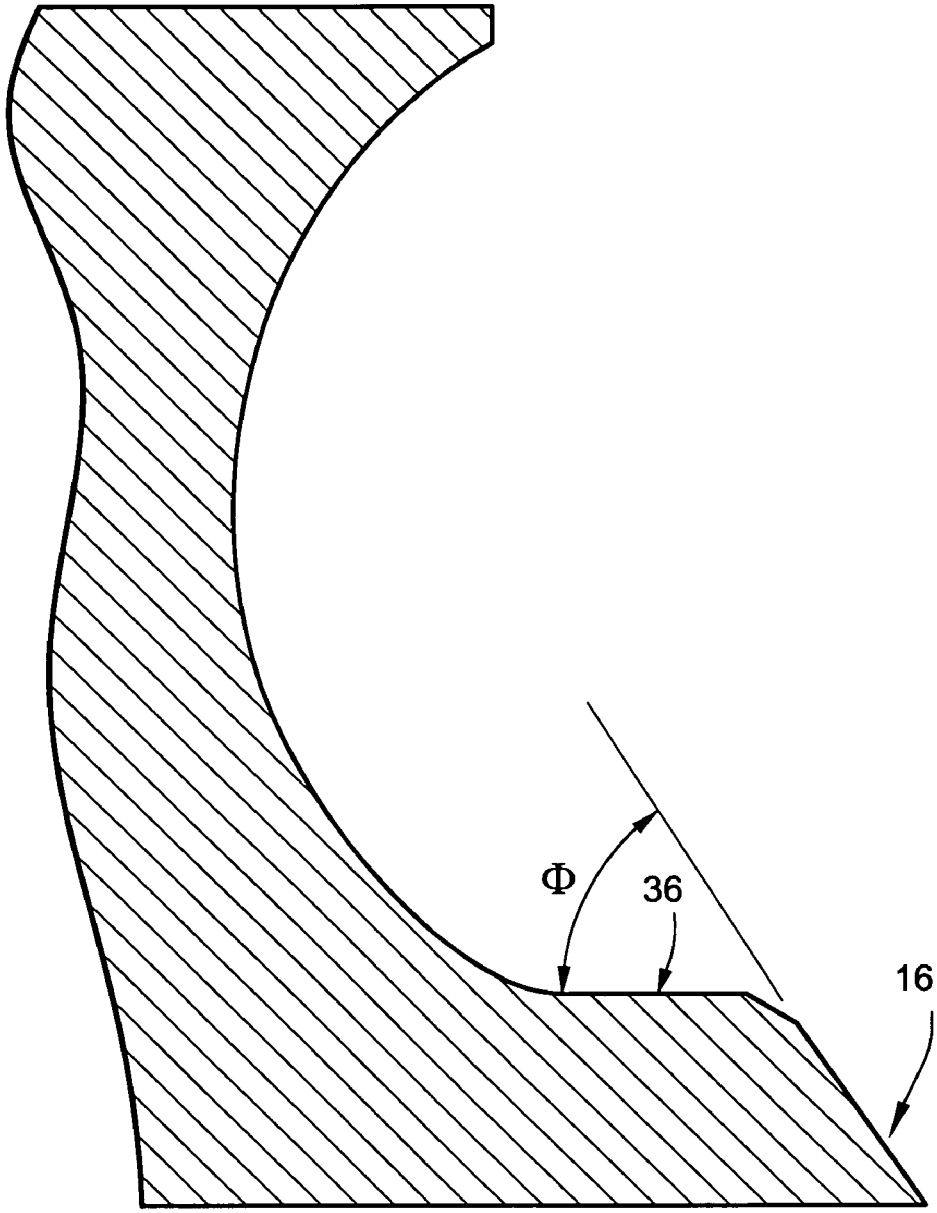
FIG. 7 shows the multi-part undercut radius of the invention and a relative position of the flat part to the dovetail pressure surface.

The flat part 36 and its angular relationship to the dovetail pressure surface 16, as shown in FIG. 7, is important in the area in separation of stresses between the edge of contact 38 and the undercut radii 32, 34. In a preferred arrangement, the angle $\phi$ between the flat part 36 and the pressure surface 16 is about 40°. Other undercut angles are possible but must be evaluated carefully. Through design of experiments finite element modeling it was determined that 40° provided the most stress reduction and most stress separation.

As noted, the axial location of the undercut fillet radius termination is defined a predetermined distance 28 from the P-cut 24 to accommodate the stress profile resulting from the P-cut 24. The predetermined distance 28 may be determined using finite element analyses or the like and may vary depending on a size of the blade assembly. Undercut runout/termination must be positioned to accommodate a compromise between manufacturing and desired stress state. An undercut too close to the P-cut relief slot will produce high stresses in the P-cut relief slot. An undercut too far away from the P-cut relief slot will not entirely clean up the prior pressure face 0.022 fillet radius 18 (which is an unacceptable condition).

The multi-part profile undercut fillet radius described herein reduces the potential for fretting-related blade failures. The profile shape of the undercut radius serves to attenuate edge of contact stresses to produce a low stress zone between the edge of contact and the larger undercut radius. Moreover, the axial location of the undercut radius termination relative to the P-cut feature serves to meet stress criteria. The design takes into account the unique stress profile of the P-cut feature and provides a solution that enables the P-cut feature to undercut radius transition area to meet its design stress parameters. The three-part profile shape of the undercut radius provides an improved stress state in the undercut compared to a single radius design.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. In a turbine or compressor blade assembly including a blade fixed to a dovetail section attachable to a wheel, the dovetail section comprising:

a dovetail shaped to fit in a correspondingly shaped slot in the wheel;

a dovetail platform serving as an interface between the blade and the dovetail; and an undercut fillet radius formed at an intersection of the dovetail platform and a dovetail pressure surface, wherein the undercut radius has a multi-part profile shape configured to attenuate edge of contact stresses, at least one part of the multi-part profile shape comprising a flat part, and wherein the undercut fillet radius is shaped and positioned such that, with the dovetail section attached to the wheel, the dovetail and the dovetail platform come into engagement with the wheel at each end of the undercut fillet radius.

2. A dovetail section according to claim 1, wherein the undercut radius comprises a three-part profile shape.

3. A dovetail section according to claim 2, wherein the three-parts include a large radius part, a small radius part, and the flat part.

4. A dovetail section according to claim 3, wherein an angle between the flat part and the pressure surface is about 40°.

5. A dovetail section according to claim 1, further comprising a P-cut formed adjacent a forward end, wherein an axial location of the undercut fillet radius termination is defined a predetermined distance from the P-cut to accommodate a stress profile resulting from the P-cut.

6. A rotor assembly comprising:

a rotor wheel including a plurality of slots; and a plurality of blade assemblies each including a blade and a dovetail section engageable in a respective one of the rotor wheel slots, wherein the dovetail section of each of the blade assemblies comprises:

a dovetail shaped to fit in a correspondingly shaped slot in the wheel, a dovetail platform serving as an interface between the blade and the dovetail, and an undercut fillet radius formed at an intersection of the dovetail platform and a dovetail pressure surface, wherein the undercut radius has a multi-part profile shape configured to attenuate edge of contact stresses, at least one part of the multi-part profile shape comprising a flat part, and wherein the undercut fillet radius is shaped and positioned such that, with the dovetail section attached to the rotor wheel, the dovetail and the dovetail platform come into engagement with the rotor wheel at each end of the undercut fillet radius.

7. A rotor assembly according to claim 6, wherein the undercut radius comprises a three-part profile shape.

8. A rotor assembly according to claim 7, wherein the three-parts include a large radius part, a small radius part, and the flat part.

9. A rotor assembly according to claim 8, wherein an angle between the flat part and the pressure surface is about 40°.

10. A rotor assembly according to claim 6, wherein the dovetail section further comprises a P-cut formed adjacent a forward end, wherein an axial location of the undercut fillet radius termination is defined a predetermined distance from the P-cut to accommodate a stress profile resulting from the P-cut.

11. A method of manufacturing a dovetail section for a compressor or turbine blade assembly engageable with a wheel slot in a rotor wheel, the method comprising:

providing a dovetail shaped to fit in the wheel slot; and forming an undercut fillet radius at an intersection of a dovetail platform and a dovetail pressure surface, wherein the undercut fillet radius is formed with a multi-pan profile shape configured to attenuate edge of contact stresses, the multi-pan profile shape including at least a large radius part, a small radius part, and a flat part, and wherein the undercut fillet radius is shaped and positioned such that, with the dovetail section attached to the wheel, the dovetail and the dovetail platform come into engagement with the wheel at each end of the undercut fillet radius.

12. A method according to claim 11, wherein an angle between the flat part and the pressure surface is about 40°.

13. A method according to claim 11, wherein the dovetail section comprises a P-cut formed adjacent a forward end, and wherein the forming step comprises terminating a forward end of the undercut fillet radius at an axial location a predetermined distance from the P-cut to accommodate a stress profile resulting from the P-cut.

* * * * *

UNITED STATES PATENT AND TRADEMARK OFFICE

CERTIFICATE OF CORRECTION

PATENT NO. : 7,594,799 B2
APPLICATION NO. : 11/519802
DATED : September 29, 2009
INVENTOR(S) : Miller et al.

It is certified that error appears in the above-identified patent and that said Letters Patent is hereby corrected as shown below:

In the Claims:

Col. 4, lines 44-45, delete "multi-pan" and insert --multi-part--

Col. 4, line 46, delete "multi-pan" and insert --multi-part--

Signed and Sealed this

Third Day of November, 2009

David J. Kappos

David J. Kappos
*Director of the United States Patent and Trademark Office*